United States Patent [19]

Hattori

[11] Patent Number: 4,468,139

[45] Date of Patent: Aug. 28, 1984

[54] PRINTING APPARATUS WITH A THERMAL PRINT HEAD INCLUDING RIBBON CARTRIDGE

[75] Inventor: Shigenori Hattori, Nagoya, Japan

[73] Assignee: Brother Kogyo Kabushiki Kaisha, Nagoya, Japan

[21] Appl. No.: 482,425

[22] Filed: Apr. 6, 1983

[30] Foreign Application Priority Data

Apr. 12, 1982 [JP] Japan ..... 57-52946[U]

[51] Int. Cl.[3] ..... B41J 3/02

[52] U.S. Cl. ..... 400/120; 400/234; 400/196

[58] Field of Search ..... 400/120, 194, 196, 207, 400/208, 208.1, 221, 223, 227, 229, 234, 236.2

[56] References Cited

U.S. PATENT DOCUMENTS

| | | | |
|---|---|---|---|
| 3,855,448 | 12/1974 | Hanagata et al. | 400/120 |
| 4,013,160 | 3/1977 | Colecchi et al. | 400/234 |
| 4,147,439 | 4/1979 | Colecchi | 400/208 |
| 4,231,667 | 11/1980 | Behrendt et al. | 400/229 X |
| 4,373,824 | 2/1983 | Olsen | 400/234 |

OTHER PUBLICATIONS

"Cassette containing both ribbon & print head", IBM Tech. Disclosure Bulletin, Vol. 23, No. 9, 2/81, p. 4298.

"Ribbon cartridge with take up assisting R13", Xe Disclosure Journal, Vol. 1, No. 2, 2/76, p.45–46.

*Primary Examiner*—E. H. Eickholt

*Attorney, Agent, or Firm*—Browdy and Neimark

[57] ABSTRACT

A printer using a ribbon having an ink layer thermally transferable to a sheet of paper. The printer comprises a thermal print head having plural heat generating elements, and a carriage carrying the print head. The carriage is pivotable between its printing position at which the print head is in contact with the paper, and its release position at which the print head is spaced from the paper. The printer further comprises a ribbon cassette removably mounted on the carriage and accommodating a supply and a take-up spool. The ribbon from the supply spool is fed in contact with the sheet of paper relative to the ribbon cassette while the carriage is moved relative to the sheet of paper. The printer includes a stationary rack extending along the printing line, and a pinion rotatably supported on the carriage. The pinion which is connected to the take-up spool is engageable with the rack while the carriage is in the printing position. Pivotal movement of the carriage to the release position causes the pinion to disengage from the rack. The rack may be formed integrally with a paper guide which partially encircles the circumference of a platen. The ribbon cassette comprises a recess accommodating the print head, a ribbon outlet opening adjacent to the recess, a ribbon guide wall for guiding the ribbon from the supply spool toward the outlet opening, and a biasing member pressing the ribbon against the guide wall.

16 Claims, 4 Drawing Figures

PRINTING APPARATUS WITH A THERMAL PRINT HEAD INCLUDING RIBBON CARTRIDGE

BACKGROUND OF THE INVENTION

The present invention relates generally to a printer having a thermal print head, and more particularly to a thermally printing apparatus wherein heat generating elements of a thermal print head are selectively activated to apply heat to segments of a thermally transferable ink layer on an ink ribbon and thereby effect a printing in a dot-matrix fashion on sheets of paper of an ordinary kind.

A printer using a thermally transferable ink is known according to Japanese patent application 54-139559 laid open for public inspection on May 27, 1981 (publication No. 56-62183), wherein there are provided two carriages which are disposed on opposite sides of a planar resilient member. The first carriage carries a thermal print head facing the resilient member, a positively driven presser roller, an idler roller, and a ribbon cassette accommodating a supply spool and a take-up spool. The first carriage is pivotable toward and away from the resilient member, i.e., between its printing and release positions, respectively. In the printing position, the two presser rollers and the thermal print head therebetween are held in pressed contact with one surface of the resilient member. An ink ribbon from the supply spool via the idler presser roller is fed in pressed contact with a sheet of paper between the thermal print head and the resilient member. A length of the ink ribbon past the thermal print head and the positively driven presser roller is re-wound on the take-up spool. The resilient member is sandwiched by the first carriage described above and the second carriage which backs the resilient member with its two support rollers of small diameter and another support roller of large diameter which are all held in pressed contact with the other surface of the resilient member. The first and second carriages are moved together through a common drive mechanism. The positively drive presser roller on the first carriage is driven by a pinion which is rotatably supported on the first carriage. The pinion is kept in engagement with a stationary rack parallel to a line of printing even while the first carriage is placed in the release position. Rotary movements of the pinion during movements of the first carriage (and the second carriage) in a printing direction are transmitted to the positively driven presser roller and the take-up spool through a one-way clutch which disconnects the power transmission while the pinion rotation is in the reverse direction during a return movement of the carriage. The positively driven presser roller and the pinion have the same outside diameter and are thus rotated at the same peripheral speeds. A torque limiter is incorporated in the transmission train linking the pinion and the take-up spool so that a torque exceeding an upper limit is not transmitted to the take-up spool. Another clutch is provided in the transmission train so that the movements of the pinion during the movements of the carriages in the printing direction are not transmitted to the positively driven pressure roller and the take-up spool when the first carriage is pivoted to its release position. Thus, the pinion in the above described printer known in the art is used to drive one of the presser rollers as well as the take-up spool, and the pinion is always engaged with the rack. The permanent rack and pinion engagement necessitates the use of a one-way clutch to stop feeding of the ink ribbon during the carriage return movement, and another clutch to stop the ribbon feed when the first carriage is pivoted to its release position (with the thermal print head away from the printing surface) even while the carriage is moved in the printing direction. The above discussed arrangements of the double-carriage design, including disconnectable transmission lines between the pinion and the presser roller and take-up spool, and use of several rollers pressed against the resilient member, will inherently complicate the structure of the printer, and increase the number of component parts and consequently push up the cost of manufacture thereof.

It is also recognized, in the art of printing using an ink ribbon coated with a thermally transferable ink layer, that a slack of the ink ribbon on the side of the supply spool owing to rotary movements of the supply spool due to inertia or vibration will cause the ink ribbon to take a waving or meandering path or have creases during a continuous printing and results in a trouble of jamming of the ribbon adjacent a printing station. Such jamming trouble is serious especially when a long underline is drawn or a succession of letters "T" is printed. In this condition, a lower or upper portion of the ribbon is subject to more heat from the print head, and consequently has more fusion of the ink layer, which causes different degrees of adhesive forces due to the fused ink materials at the upper or lower portion of the ribbon transversely of the ribbon width, thereby subjecting one of the upper and lower width portions to more tension than the other. Thus, the ribbon tends to have creaes or be offset from its normal path, i.e., brought out of alignment with the heat generating elements of the print head, causing an unclear printing of characters or printing failure at the top or bottom of the characters.

To overcome the above problem, it has been proposed to provide the supply spool with biasing means for applying tension to a portion of the ribbon adjacent the supply spool in a direction opposite to a direction of the ribbon feed in order to prevent the ribbon from being slackened. This solution to the prior problem, however, has a disadvantageous aspect that the tension applied to the ribbon acts to prevent the ribbon from faithfully following a speed of a relatively movement between the ribbon cassette and the paper, and therefore the ribbon tends to slip in frictional contact with the printing surface of the paper, which results in staining or soiling the printing surface with the ink. Further, the tension applied by the biasing means counteracts a winding force of the take-up spool and thus prevents a correct or sufficient winding action of the take-up spool especially when the printer is powered by a battery and the take-up spool is driven with a small torque.

SUMMARY OF THE INVENTION

It is accordingly an object of the present invention to provide a printing apparatus having a thermal print head which is simple in construction, composed of relatively few parts and economical to manufacture, and which is capable of effecting a printing on an ordinary sheet of paper through an ink ribbon having a layer of thermally transferable inking material.

Another object of the invention is to provide such type of thermally printing apparatus which permits a smooth feed of the thermally transferable ink ribbon without jamming, waving, creasing or any other behaviors that prevent clear and complete printing of characters.

A further object of the invention is the provision of an improved ribbon cassette for use with a printing apparatus of the type described in connection with the above objects.

According to the present invention, there is provided a printing apparatus using an ink ribbon having a layer of ink thermally transferable to a printing surface of a sheet of paper, which comprises:

paper support means for holding said sheet of paper;

a thermal print head having a plurality of selectively activated heat generating elements;

a carriage carrying said thermal print head, movable along a line of printing on said paper support means, and pivotable between its printing position and its release position about an axis parallel to said line of printing, said carriage forcing said thermal print head against said printing surface of the sheet of paper while the carriage is placed in said printing position, said thermal print head being spaced from said printing surface while said carriage is placed in said release positions;

first drive means for moving said carriage along said line of printing;

second drive means for pivoting said carriage between said printing and release positions;

a ribbon holding device associated with said carriage for holding said ink ribbon, and including a supply spool and a take-up spool, which spools are rotatably supported by said carriage, a length of said ink ribbon looped out of said ribbon holding device and nipped between said sheet of paper and said thermal print head being fed in contact with the sheet of paper relative to said ribbon holding device while said carriage placed in said printing position is moved relative to the sheet of paper, and re-wound on said take-up spool;

a stationary rack extending along said line of printing; and a pinion rotatably supported on said carriage and operatively connected to said take-up spool, said pinion engaging said rack to rotate said take-up spool while said carriage is placed in said printing position, and disengaging from said rack when the carriage is pivoted to said release position.

According to the present invention, there is also provided a ribbon cassette for holding an ink ribbon having a layer of ink thermally transferable to a printing surface of a sheet of paper on a printing apparatus which includes a thermal print head having a plurality of selectively activated heat generating elements and further includes a carriage carrying said thermal print head and movable along a line of printing, said carriage forcing said ink ribbon via a flat surface of said thermal print head against said sheet of paper and thereby feeding the ink ribbon in contact with said printing surface while the carriage is moved relative to the sheet of paper, said thermal print head being spaced from said printing surface while the carriage is placed in said release position, said ribbon cassette comprises:

a supply spool on which said ink ribbon is wound;

a take-up spool on which said ink ribbon is re-wound after it passes between said printing surface and said thermal print head;

a casing accommodating said supply and take-up spools and removably mounted on said carriage, said casing including portions defining a ribbon outlet opening adjacent to said thermal print head when the cassette is mounted on the carriage, said casing further including a ribbon guide wall adjacent to said outlet opening and extending so as to guide said ink ribbon from said supply spool toward said outlet opening, said casing further including a biasing member pressing said ink ribbon against a surface of said ribbon guide wall to give a resistance to a sliding movement of the ink ribbon.

BRIEF DESCRIPTION OF THE DRAWINGS

The above and other objects, features and advantages of the present invention will become more apparent from reading the following description of the preferred embodiment taken in connection with the accompanying drawings in which.

DETAILED DESCRIPTION OF THE PREFERRED EMBODIMENT

Figure 1:
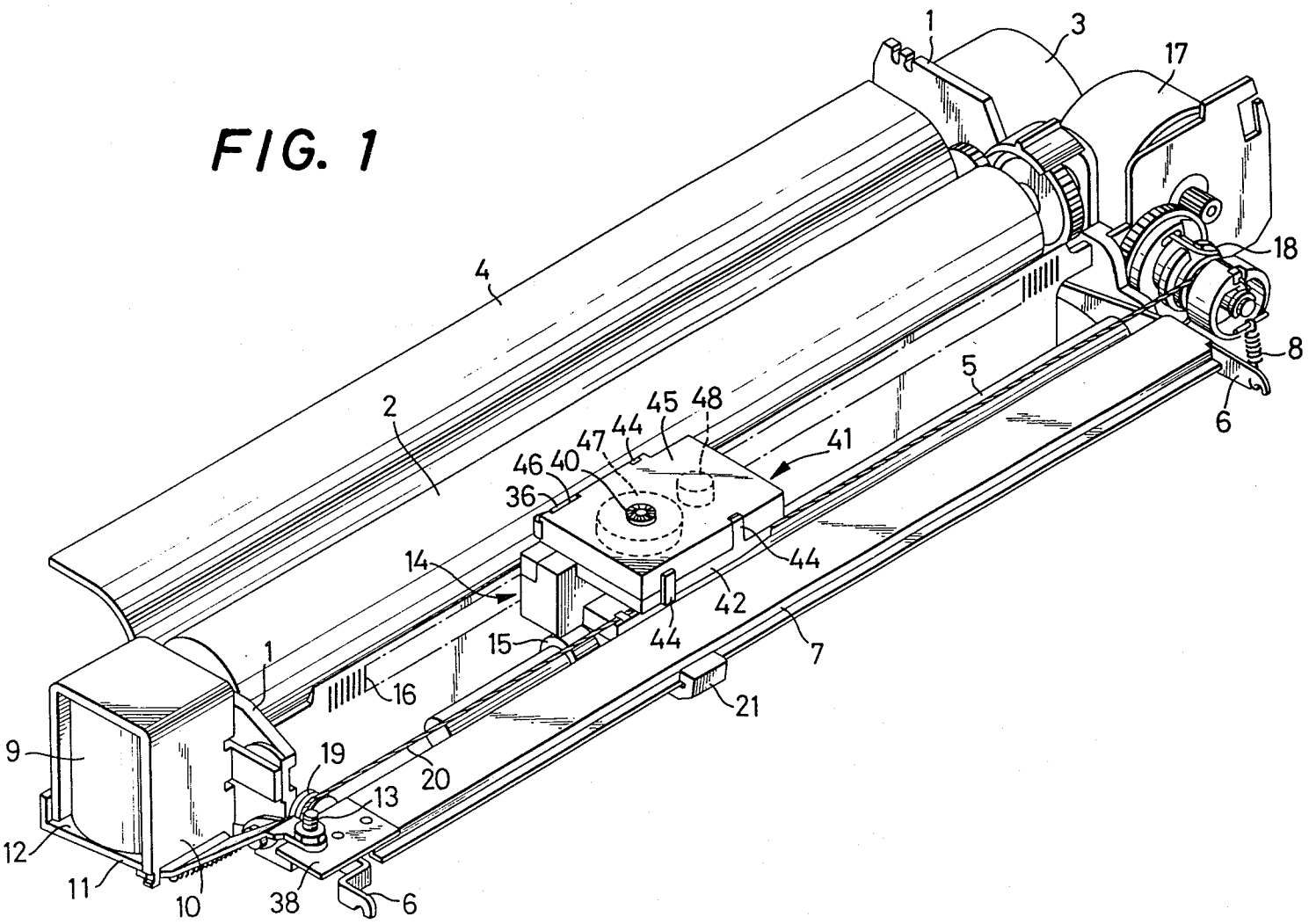
FIG. 1 is a fragmentary view in perspective of one embodiment of a printing apparatus of the present invention.

Referring to FIG. 1, there is partly illustrated in perspective a printing apparatus constructed according to this invention, wherein a platen 2 serving as paper support means for holding a sheet of paper is rotatably supported by a pair of side frames 1 and driven by a paper feed or advance motor 3 which is disposed outwardly adjacent to the right side frame 1 (as viewed in the figure). Thus, the platen 2 not only acts as a paper support but also as a paper feeding roller linked with the drive source 3. Between the right and left side frames 1 and beneath the platen 2, there is provided a stationary paper guide frame 4 which includes a paper guide **4*a* extending along or encircling the lower circumference of the platen 2 in slightly radially spaced relation therewith, as most clearly shown in FIG. 2. The paper guide frame 4 further includes a front upright portion which provides a rack 16 extending along the length or axis of the platen 2, that is, parallel to a line of printing. The rack 16 may be an integral part of the guide frame 4. Preferably, the guide frame 4 and the rack 16** are molded of a synthetic resin material as a unitary member.

As seen in FIG. 1, a guide rod 5 is supported between the frames 1 so as to extend along the printing line in front of the platen 2. The guide rod 5 carries at both ends thereof oscillating levers 6 which are pivotable about the axis of the guide rod 5. Front portions of the right and left oscillating levers 6 are spanned by a release plate 7. The levers 6 and the release plate 7 are biased upwardly by tension springs 8 which are connected at one end to the respective frames 1 and at the other end to the free ends of the respective oscillating levers 6. The release plate 7 is, however, adapted to be slightly pivotable in a substantially vertical direction.

There are disposed, outwardly of the left frame 1, a solenoid 9 having a yoke portion 10, and a solenoid lever 11 which is supported at the front lower end of the yoke portion 10 so that the lever 11 is pivotable within a predetermined angular range in a vertical plane (in FIG. 1). The rear arm of the solenoid lever 11 has a horizontal surface 12 which faces the bottom surface of the solenoid 9, while the front arm of the solenoid lever 11 carries at its end an adjusting screw 13 whose lower end is held in abutting contact with the upper surface of an engagement plate 38 secured to the left side end of the release plate 7. With the above arrangement, attraction of the horizontal surface 12 of the rear arm of the lever 11 to the bottom surface of the solenoid 9 upon energization of the solenoid 9 will cause the lever 11 to pivot clockwise, as viewed in FIG. 1, whereby the threaded adjusting screw 13 on the front arm of the lever 11 is moved down while pressing downwardly the release plate 7 against a biasing force of the tension springs 8.

Figure 2:
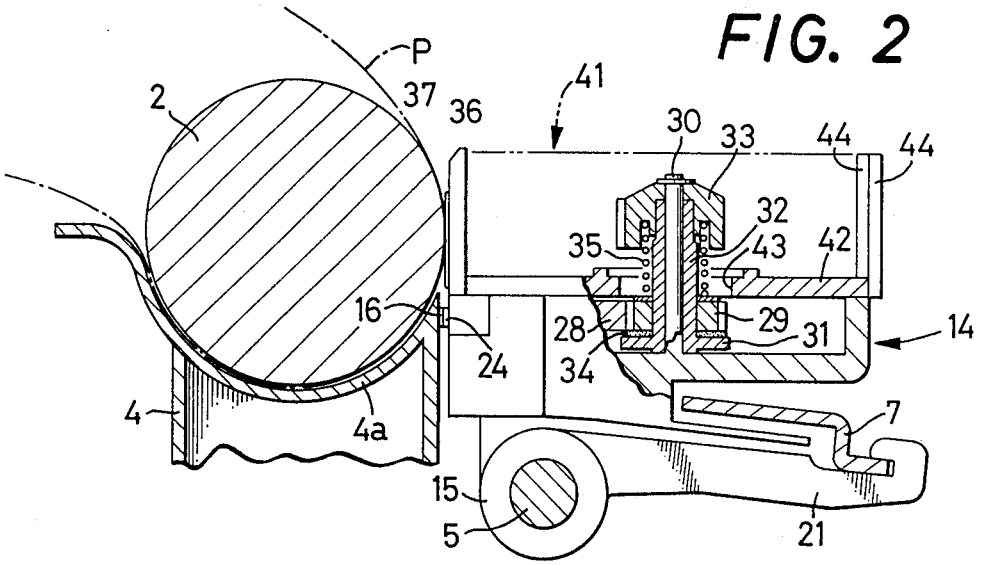
FIG. 2 is a side elevation, partly broken away to show interior construction, of a carriage of the printing apparatus of FIG. 1.

As shown in FIGS. 1 and 2, the guide rod 5 extends through a cylindrical portion 15 of a carriage 14 to support the carriage such that it is slidably movable longitudinally of the rod 5. The carriage 14 is connected to a drive wire 20 which is connected to a driving pulley 18 coupled with a carriage drive motor 17 disposed outwardly of the right side frame 1, and with a driven pulley 19 rotatably supported by the left side frame 1. Rotation of the driving pulley 18 in opposite directions will cause the carriage 14 to move left and right via the wire 20 while the carriage is guided by the guide rod 5 along the length of the platen 2. The carriage 14 includes a frontwardly projecting portion 21 a front end of which is held in engagement with a front edge of the release plate 7, whereby a downward movement of the release plate 7 upon energization of the solenoid 9 will pivot the carriage 14 downwardly (clockwise in FIG. 2) a slight angle about the guide rod 5, i.e., pivot the carriage 14 from its printing position to its release position.

Figure 3:
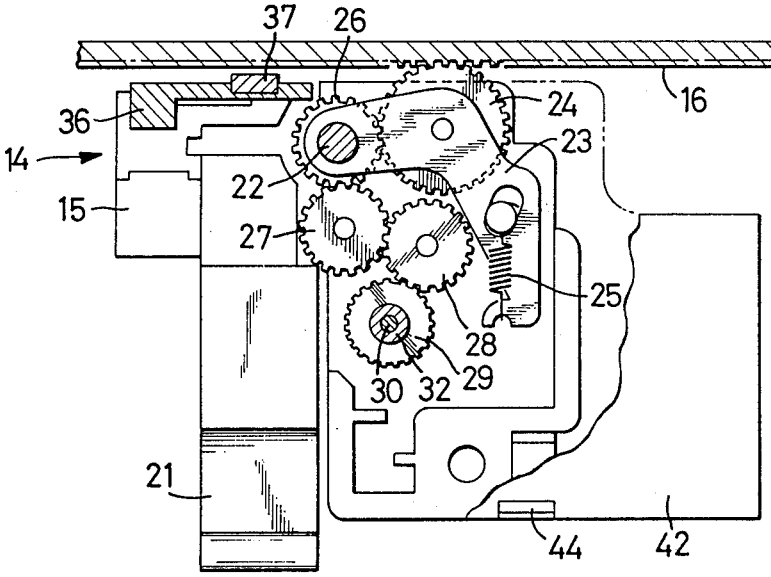
FIG. 3 is a plan view of the carriage, also partly broken away to show its interior construction.

As shown in FIG. 3, the rear portion of the carriage 14 has a shaft pin 22 about which is supported a support arm 23 which is a generally L-shaped planar member. The support arm 23 carries, at its intermediate portion, a pinion 24 which is normally biased, by a compression spring 25 engaging the free end of the support arm 23, toward the rack 16 on the paper guide frame 4. In a printing period of operation of the printer, the pinion 24 mates with the teeth of the rack 16 and is rotated as the carriage 14 is moved. Rotary movement of the pinion 24 is transmitted through three idler gears 26, 27 and 28 to a ribbon drive gear 29.

There is most clearly illustrated in FIG. 2 a take-up spool shaft 30 which rotatably supports a sleeve 32 and a drive wheel 31 integral with the sleeve 32. The upper end of the sleeve 32 is press-fitted in a star wheel 33 (also seen in FIG. 4) such that they are rotated as an integral unit. The sleeve 32 also rotatably supports the ribbon drive gear 29 which is operatively connected to the pinion 24 as previously discussed. Between the lower surface of the drive gear 29 and the upper surface of the drive wheel 31, there is interposed a frictional torque limiter disc 34 made of felt. The drive gear 29 is biased toward the clutch disc 34 and the drive wheel 31 by a compression spring 35 interposed between the upper surface of the gear 29 and the lower surface of the start wheel 33. Thus, the clutch disc 34 is kept squeezed between the ribbon drive gear 29 and the drive wheel 31, whereby the drive wheel 31 is rotatable through friction relative to the drive gear 29 when the latter is rotated. As a result, a linear movement of the carriage 14 in a printing direction, i.e., to the right as viewed in FIG. 3, is converted into a counterclockwise rotation of the star wheel 33 through rotation of the pinion 24, gears 26–29, drive wheel 31, and sleeve 32. The torque limiter 34 and the compression spring 35 are so designed and constructed that the torque limiter 34 will slip relative to the gear 29 and the wheel 31 when a torque of the pinion 24 or the gear 29 exceeds a predetermined upper limit, thereby preventing transmission of an excessive torque to the star wheel 33.

On the left, rear portion of the carriage 14, is provided a metallic heat radiating plate 36, as shown in FIGS. 2 and 3, which stands upright and carries, at a surface thereof facing the platen 2, a thermal print head 37 which incorporates a plurality of heat generating elements (not shown). While a printing is in progress with the carriage 14 placed in its printing position, a ribbon 49 having a thermally transferable ink layer (hereinafter simply called "ink ribbon") is held, by a flat surface of the print head 37 and through a biasing force of the tension springs 8, in abutting contact with a printing surface of a sheet of paper P of an ordinary material wound on the platen 2. Upon energization of the solenoid 9 at the end of a printing line, for example, the carriage 14 is pivoted away from the platen 2, i.e., from its printing position. Consequently, the carriage 14 and the thermal print head 37 are set to their release positions at which the surface of the head 37 is spaced from the printing surface of the paper P.

The ink ribbon 49 is fed from, and held by, a ribbon cassette 41 which is designed as a ribbon holding device removably mounted on the carriage 14. As shown in FIGS. 1 and 2, a mounting bracket 42 is secured to the top of the carriage 14. The bracket 42 has a central opening 43 through which the sleeve 32 and the related parts extend, and further has three retainer members 44 which stand upright, two at the front side edge and one at the rear side edge. A cassette casing 45 rests on the mounting bracket 42 and held in position by the retainer members 44. The cassette casing 45 has, at its left portion of the rear wall, a recess 46 which is open toward the platen 2 and accommodates upper portions of the heat radiating plate 36 and the print head 37.

Within left and right halves of the cassette casing 45 are rotatably mounted a take-up spool 47 and a supply spool 48, respectively. The take-up spool 47 has a central cavity in which the star wheel 33 is received. The teeth of the star wheel 33 are engageable with three engagement pawls **47*a* which protrude in the central cavity of the take-up spool 47. The ink ribbon 49 which is a synthetic resin tape coated with an ink, is supplied from the supply spool 48, fed through squeezing contact thereof with the printing surface, and re-wound on the rotating take-up spool 47 after it is moved past the thermal print head 37. Between the two spools 47 and 48, there is provided a generally Vee-shaped (in plan) spring 50 having two arms which are connected to each other and fixed at the connection to a front part of a bottom plate of the cassette casing 45. The two arms are kept in pressed contact with the outermost turns of rolls of the ink ribbon 49 wound on the supply and take-up spools 48 and 47, so that the ink ribbon 49 will not be loose or slackened due to free rotation of the spools caused by vibrations thereof or for other reasons. Numeral 40 in FIG. 1 designates a knob for manually rotating the take-up spool 47**.

Figure 4:
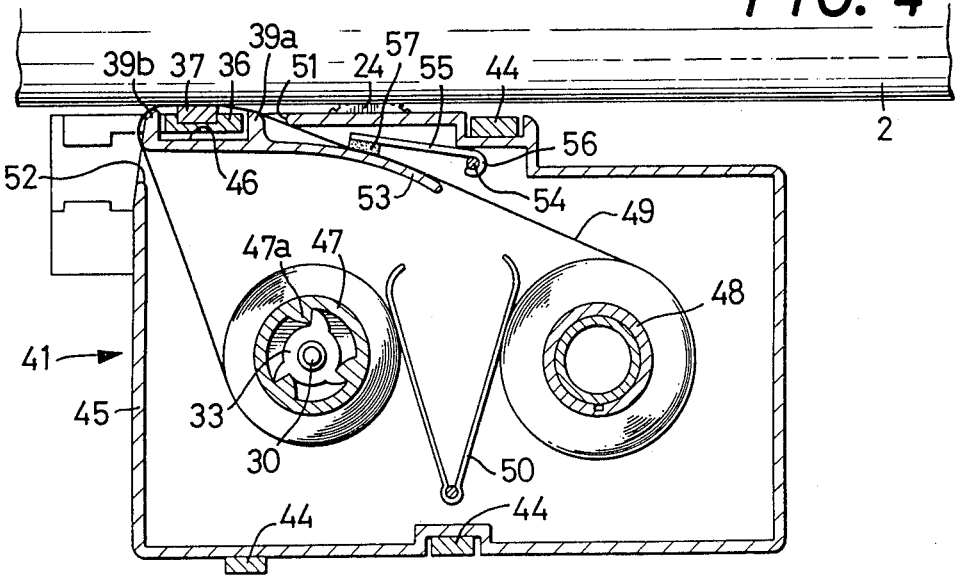
FIG. 4 is a cross sectional plan view of a ribbon cassette of the printing apparatus.

As illustrated in FIG. 4, the rear and left side walls of the cassette casing 45 have portions to define an outlet opening 51 and an inlet opening 52, respectively, which openings 51 and 52 are located adjacent to the recess 46. Two ribbon guides **39*a* and 39*b* are formed at opposite ends of the recess 46. The first ribbon guide 39*a* is located between one end of the recess 46 and the outlet opening 51, and the second ribbon guide 39***b* between the other end of the recess and the inlet opening 52. The guiding portions of the ribbon guides 39 are offset from the flat surface of the print head 37 toward the interior of the casing 45 in a direction normal to the line of printing. A length of the ink ribbon supplied from the supply spool 48 is pulled out of the casing through the outlet opening 51, and fed along a first straight path between the first ribbon guide 39*a* and the right-hand side end of the print head 37, and along a second straight path in contact with the flat surface of the print head 37 while being nipped between the surfaces of the paper P and the print head 37. Then, the ribbon 49 is fed along a third straight path between the left-hand side end of the print head 37 and the second ribbon guide 39*b*, and led to the inlet opening to be drawn into the casing 45 and finally re-wound on the take-up spool 47. Obviously, the ink ribbon 49 is held by the thermal print head 37 in face-to-face contact with the printing surface only while the ribbon is passing along the second straight path. Upon generation of appropriate printing signals, the heat generating elements of the head 37 are selectively activated to apply heat to corresponding segments of an ink layer on the ribbon, which are transferred to the surface of the paper P to effect a printing of a desired character.

Disposed inwardly of the rear wall of the casing 45, is a guide wall 53 which extends from the first ribbon guide 39*a* toward the supply spool 48 in order to guide the ribbon 49 to the outlet opening 51. Adjacent to the guide wall 53, there is provided a leaf spring 55 whose one end is turned for engagement with a pin 54 which is located in slightly spaced relation with the inner surface of the rear wall of the casing 45. This leaf spring 55 is nipped, at a portion thereof adjacent the turned end 56, between the said inner surface and the pin 54. The other end of the leaf spring 55 has a presser piece 57 made of felt. The presser piece 57 regularly urges, with a biasing force of the spring 50, the ink ribbon 49 against the surface of the guide wall 53 to apply a constant force of tension to the ribbon 49 before it reaches the thermal print head 37.

When the carriage 14 is moved to the right for printing a line of characters with the ink ribbon 49 being nipped between the print head 37 and the paper P on the platen 2 as shown in FIGS. 2 and 4, the ink ribbon 49 in pressed contact with the paper P is moved sliding on the surface of the print head 37 along the second straight path indicated above, together with the paper P relative to the ribbon cassette 41 (carriage 14). Consequently, an unused length of the ink ribbon 49 is pulled from a roll on the supply spool 48 and directed through the outlet opening 51 to the print head 37 along the first straight path. In the meantime, the pinion 24 engaging the rack 16 on the paper guide frame 4 is rotated by the movement of the carriage 14 in the printing position, and the rotary movements of the pinion 24 are transmitted to the star wheel 33 via the idler gears 26, 27, and 28, ribbon drive gear 29, frictional torque limiter 34, drive wheel 31 and sleeve 32, as shown in FIG. 3. Rotation of the star wheel 33 causes the take-up spool 47 within the cassette 41 to rotate pulling the used portion of the ribbon 49 through the inlet opening 52, whereby the ribbon is re-wound on the take-up spool.

It is noted that the feed of the ink ribbon 49 from the supply spool 48 is caused not with a re-winding force of the take-up spool 47 but with a frictional force between the printing surface of the paper P and the surface of the ribbon 49. Therefore, an amount of feed of the ribbon 49 is equal to a distance of movement of the carriage 14 relative to the paper P, i.e., equal to a lenth of a printed line of character (for one character to be printed, the ribbon is fed by a distance equal to a width of that character). In other words, the ribbon 49 and the paper P are moved in contact with each other always at substantially the same speed relative to the carriage 14. This means that there is substantially no slip between the ink layer of the ribbon 49 and the printing surface of the paper P, and consequently no chance for staining the printing surface with the ink.

It is also noted that, to keep constant a re-winding amount of the ribbon 49 per unit time, the speed of rotation of the take-up spool 47 has to be reduced as the diameter of the re-wound roll of the ribbon 49 is increased. In view of the fact that the ribbon drive gear 29 is rotated at a constant speed as the travelling speed of the carriage 14 is constant, the present embodiment of the invention uses the torque limiter 34, as previously discussed, which permits the ribbon drive gear 29 to slip with respect to the sleeve 32 and the star wheel 30 which are rotated integrally with the take-up spool 47. This arrangement prevents a gradual increase in the re-winding speed of the take-up spool 47 in proportion to a gradual increase in the diameter of the re-wound ribbon roll, and consequently prevents the take-up spool 47 from pulling the ribbon 49 with an excessive tension after the diameter of the re-wound ribbon roll has increased to a great extent as compared with the diameter of the spool 47. Thus, the tension at which the ribbon 49 is re-wound on the take-up spool 47 is kept at a substantially constant level irrespective of the current diameter of the ribbon roll on the spool 47. Thus, as previously described, a torque of the pinion 24 exceeding a preset upper limit will not be transmitted to the take-up spool 47.

As previously indicated, a printing of a character is achieved by transferring, to the surface of the paper sheet P, predetermined dot-matrix segments of the ink layer of the ribbon 49 which have been fused by heat from the appropriate heat generating elements of the thermal print head 37. A portion of the ribbon 49 including the fused segments of the ink layer remains to be stuck to the printing surface due to adhesive force resulting from the fused ink even after the selected character has been printed. This adhesive force acts to drag the ribbon 49 when the fused segments are separated from the sheet of paper P. Therefore, in general, a concentration of the fused segments on the upper or lower longitudinal portion of the ribbon 49 will cause different magnitudes of drags at the different transverse areas of the ribbon. This tendency is prominent for example when a long underline is drawn or a number of letters "T" are printed in succession. In such instance, the ink ribbon may crease, meander or run out of alignment with the print head, causing unclear or dirty printing, or printing failure at the top or bottom sections of a character.

In the printing apparatus using the ribbon cassette 41 according to the invention, however, such trouble with the ink ribbon 49 as indicated above is effectively eliminated because the guide wall 53 and the presser piece 57 of the leaf spring 55 cooperate to hold in place a portion of the ribbon 49 adjacent the outlet opening 51 so as to prevent an otherwise possible vertical shifting or offsetting behavior of the ribbon due to an unbalanced drag applied thereto. Further, the Vee-shaped spring 50 prevents a free rotation of the spool 48, and the leaf spring 55 maintains a constant tension of the ribbon 49 between the presser piece 57 and the outlet opening 51. Thus, a fresh length of the ribbon 49 is smoothly supplied from the spool 48 toward the thermal print head 37 with neither a slack nor a jamming thereof on the side of the supply spool 48.

After completion of printing of characters along one line, the solenoid 9 is energized in response to depression of a carriage return key on a keyboard, and the solenoid lever 11 is pivoted, through attraction by the solenoid, to depress the release plate 7 in the downward direction, whereby the carriage 14 is rotated about the guide rod 5 to its release position, and the thermal print head 37 and the ink ribbon 49 are separated from the printing surface of the paper P while at the same time the pinion 24 disengages from the rack 16 on the paper guide frame 4. Then, the carriage 14 is returned to the left margin position without rotation of the pinion 24 and resultant feeding of the ink ribbon 49.

As described hereinabove, the present embodiment of the printing apparatus is capable of preventing the ink ribbon 49 from slipping or sliding on the printing surface of the paper P and from soiling the printing surface. This capability is obtained in a simpler construction as compared with a conventional arrangement which employs biasing means for applying a tension to the ribbon in a direction opposite to the ribbon feeding direction. Further, unlike the conventional tension spring arrangement, the present arrangement employs a smaller force with which the ribbon 49 is pressed against the guide wall 53 by the presser piece 57 on the leaf spring 55, and accordingly allows a reduction in torque required to drive the take-up spool 47, thereby making it possible to operate the printing apparatus with a battery.

While the present invention has been described in its preferred embodiment, it is to be understood that the invention is not limited thereto, but may be otherwise embodied. For example, the leaf spring 55 with the presser piece 57 secured thereto may be replaced by any other biasing arrangements such as a resilient member interposed between the inner surface of the rear side wall of the cassette casing 45 and the ribbon guide wall 53. Other changes and modifications may be made to those skilled in the art within the scope of the following claims.

What is claimed is:

1. A printing apparatus using an ink ribbon having a layer in ink thermally transferable to a printing surface of a sheet of paper, which comprises:

paper support means for holding said sheet of paper;

a thermal print head having a plurality of selectively activated heat generating elements;

a carriage carrying said thermal print head, movable along a line of printing on said paper support means, and pivotable between its printing position and its release position about an axis parallel to said line of printing, said carriage forcing said thermal print head against said printing surface of the sheet of paper while the carriage is placed in said printing position, said thermal print head being spaced from said printing surface while said carriage is placed in said release position;

first drive means for moving said carriage along said line of printing;

second drive means for pivoting said carriage between said printing and release positions;

a ribbon holding device associated with said carriage for holding said ink ribbon, and including a supply spool and a take-up spool, which spools are rotatably supported by said carriage, a length of said ink ribbon looped out of said ribbon holding device and nipped between said sheet of paper and said thermal print head being fed in contact with the sheet of paper relative to said ribbon holding device while said carriage placed in said printing position is moved relative to the sheet of paper, and re-wound on said take-up spool;

a stationary rack extending along said line of printing; and a pinion rotatably supported on said carriage and operatively connected to said take-up spool, said pinion engaging said rack to rotate said take-up spool while said carriage is placed in said printing position, and disengaging from said rack when the carriage is pivoted to said release position.

2. A printing apparatus as claimed in claim 1, further comprising a torque limiter operatively connected to said pinion and said take-up spool, said torque limiter slipping when a torque of said take-up spool exceeds an upper limit, and thereby preventing transmission of the torque above said upper limit to said take-up spool.

3. A printing apparatus as claimed in claim 1, wherein said paper support means comprises a platen rotatable about said axis parallel to the line of printing.

4. A printing apparatus as claimed in claim 1, which further comprises a support member carrying said pinion rotatably and supported on said carriage pivotably toward and away from said rack, and biasing means connected to said support member for urging said pinion toward said rack for engagement therewith.

5. A printing apparatus as claimed in claim 1, wherein said ribbon holding device comprises a casing accommodating said supply and take-up spools, said casing cooperating with the supply and take-up spools to constitute a ribbon cassette, said carriage comprising cassette retainer means for removably mounting said ribbon cassette on the carriage.

6. A printing apparatus as claimed in claim 5, wherein said ribbon cassette including portions defining a ribbon outlet opening adjacent to said thermal print head when the ribbon cassette is mounted on the carriage, and further including a ribbon guide wall adjacent to said outlet opening and extending within said casing so as to guide said ink ribbon from said supply spool toward said outlet opening, said ribbon cassette further including a biasing member pressing said ink ribbon against a surface of said ribbon guide wall to give a resistance to a sliding movement of the ink ribbon.

7. A printing apparatus as claimed in claim 5, wherein said casing including portions defining a recess which is open toward said paper support means, said recess accommodating said thermal print head when said ribbon cassette is mounted on the carriage, said casing further including portions defining a ribbon outlet opening adjacent to one end of said recess and a ribbon inlet opening adjacent to the other end of the recess.

8. A printing apparatus as claimed in claim 7, wherein said casing includes a wall facing said paper support means, said recess being formed in said wall at a position away from a central portion thereof along said line of printing.

9. A printing apparatus as claimed in claim 7, wherein said thermal print head has a flat surface contacting said printing surface of said sheet of paper while the carriage is placed in said printing position, said casing further including a first ribbon guide between said outlet opening and said one end of the recess, and a second ribbon guide between said inlet opening and said other end of the recess, said first and second ribbon guides being offset, when the ribbon cassette is mounted on the carriage, from said flat surface of the thermal print head toward the interior of the casing in a direction normal to said line of printing, said ink ribbon passing along a first straight path between said first ribbon guide and one end of said flat surface, a second straight path in contact with said flat surface, and a third straight path between said second ribbon guide and the other end of said flat surface, said ink ribbon being held by said thermal print head in face-to-face contact with said printing surface only while the ribbon is passing along said second straight path.

10. A printing apparatus using an ink ribbon having a layer of ink thermally transferable to a printing surface of a sheet of paper, which comprises:

paper support means for holding said sheet of paper;

a thermal print head having a plurality of selectively activated heat generating elements;

a carriage carrying said thermal print head, and movable along a line of printing on said paper support means;

carriage drive means for moving said carriage along said line of printing;

a ribbon holding device associated with said carriage for holding said ink ribbon, and including a supply spool and a take-up spool, which spools are rotatably supported by said carriage, a length of said ink ribbon looped out of said ribbon holding device and nipped between said sheet of paper and said thermal print head being fed in contact with the sheet of paper while said carriage placed in said printing position is moved relative to said sheet of paper, and re-wound on said take-up spool;

a paper feeding roller rotatable about an axis parallel to said line of printing, and having a circumferential surface for feeding the sheet of paper in a direction normal to said line of printing;

a stationary paper guide which has a guide surface encircling, and radially spaced from, a part of said circumferential surface of the paper feeding roller so as to guide the sheet of paper along the circumferential surface;

a rack integral with said paper guide and extending along said line of printing; and a pinion rotatably supported on said carriage and operatively connected to said take-up spool, said pinion being engageable with said rack and rotatable to rotate said take-up spool when said carriage is moved along said line of printing.

11. A printing apparatus as claimed in claim 10, wherein said paper guide and said rack are integrally molded of a synthetic resin material.

12. A printing apparatus as claimed in claim 10, wherein said carriage is pivotable between its printing position and its release position about said axis, said carriage forcing said thermal print head against said printing surface of the sheet of paper while the carriage is placed in said printing position, said thermal print head being spaced from said printing surface and said pinion disengaging from said rack when said carriage is pivoted to said release position.

13. A printing apparatus as claimed in claim 10, where said paper feeding roller is a platen holding said sheet of paper.

14. A ribbon cassette for holding an ink ribbon having a layer of ink thermally transferable to a printing surface of a sheet of paper on a printing apparatus which includes a thermal print head having a plurality of selectively activated heat generating elements and further includes a carriage carrying said thermal print head and movable along a line of printing, said carriage forcing said ink ribbon via a flat surface of said thermal print head against said sheet of paper and thereby feeding the ink ribbon in contact with said printing surface while the carriage is moved relative to the sheet of paper, said thermal print head being spaced from said printing surface while the carriage is placed in said release position, said ribbon cassette comprising:

a supply spool on which said ink ribbon is wound;

a take-up spool on which said ink ribbon is re-wound after it passes between said printing surface and said thermal print head;

a casing accommodating said supply and take-up spools and removably mounted on said carriage, said casing including a rear wall facing said printing surface, said rear wall having portions defining a recess at a position away from a central portion of the rear wall along said line of printing, said recess being open toward said printing surface and accommodating said thermal print head when the cassette is mounted on the carriage, said rear wall further having portions defining a ribbon outlet opening adjacent to one end of said recess, said casing further including portions defining a ribbon inlet opening adjacent to the other end of said recess, and further including a ribbon guide wall adjacent to said outlet opening, said ribbon guide wall extending so as to guide said ink ribbon from said supply spool toward said outlet opening, said casing further including a biasing member pressing said ink ribbon against a surface of said ribbon guide wall to give a resistance to a sliding movement of the ink ribbon, said ink ribbon from said outlet opening passing said thermal print head and being directed to said take-up spool through said inlet opening.

15. A ribbon cassette for holding an ink ribbon having a layer of ink thermally transferable to a printing surface of a sheet of paper on a printing apparatus which includes a thermal print head having a plurality of selectively activated heat generating elements and further includes a carriage carrying said thermal print head and movable along a line of printing, said carriage forcing said ink ribbon via a flat surface of said thermal print head against said sheet of paper and thereby feeding the ink ribbon in contact with said printing surface while the carriage is moved relative to the sheet of paper, said thermal print head being spaced from said printing surface while the carriage is placed in said release position, said ribbon cassette comprising:

a supply spool on which said ink ribbon is wound;

a take-up spool on which said ink ribbon is re-wound after it passes between said printing surface and said thermal print head;

a casing accommodating said supply and take-up spools and removably mounted on said carriage, said casing including: (a) portions defining a recess which is open toward said printing surface and accommodates said thermal print head when the cassette is mounted on the carriage; (b) portions defining a ribbon outlet opening adjacent to one end of said recess; (c) portions defining a ribbon inlet opening adjacent to the other end of said recess, said ink ribbon being fed through said outlet opening and past said thermal print head, and directed to said take-up spool through said inlet opening; (d) a first ribbon guide between said outlet opening and said one end of the recess; and (e) a second ribbon guide between said inlet opening and said other end of the recess, said first and second ribbon guides being offset, when the cassette is mounted on the carriage, from said flat surface of the thermal print head toward the interior of the casing in a direction normal to said line of printing; and (f) means for applying a tension to a length of said ink ribbon before said first ribbon guide, said ink ribbon from said outlet opening being fed along a first straight path between said first ribbon guide and one end of said flat surface, along a second straight path in contact with said flat surface, and along a third straight path between said second ribbon guide and the other end of said flat surface, said ink ribbon being held by said thermal print head in face-to-face contact with said printing surface only while the ribbon is passing along said second straight path.

16. A ribbon cassette as claimed in claim 15, wherein said means for applying a tension comprises a ribbon guide wall located adjacent to said outlet opening and extending so as to guide said ink ribbon from said supply spool toward said outlet opening, and further comprising a biasing member pressing said ink ribbon against a surface of said ribbon guide wall to give a resistance to a sliding movement of the ink ribbon.

* * * * *